US005958183A

United States Patent [19]

Graf et al.

[11] Patent Number: 5,958,183

[45] Date of Patent: Sep. 28, 1999

[54] RIVER WATER HEAT EXCHANGER FOR COOLING PROCESS LIQUID IN A PAPER-MAKING MACHINE

[75] Inventors: Edwin X. Graf, Menasha; Walter F. Randolph, Green Bay, both of Wis.

[73] Assignee: Voith Sulzer Paper Technology North America, Inc., Appleton, Wis.

[21] Appl. No.: 08/866,663

[22] Filed: Jun. 5, 1997

[51] Int. Cl.[6] ..... D21C 11/06

[52] U.S. Cl. ..... 162/47; 162/190

[58] Field of Search ..... 162/47, 189, 190, 162/263; 165/132, 140, 11.1, 301, 70, DIG. 8

[56] References Cited

U.S. PATENT DOCUMENTS

| | | | |
|---|---|---|---|
| 1,148,605 | 8/1915 | McHugh | 165/140 |
| 1,925,446 | 9/1933 | Huntley | 165/132 |
| 2,029,360 | 4/1936 | Dean | 92/2 |
| 2,360,408 | 10/1944 | Dunn et al. | 165/140 |
| 3,602,294 | 8/1971 | Wanson | 165/11 |
| 4,008,755 | 2/1977 | Vandamme | 165/11 |
| 4,228,845 | 10/1980 | Cowling | 165/132 |
| 4,571,282 | 2/1986 | Almond et al. | 162/47 |

*Primary Examiner*—Dean T. Nguyen
*Attorney, Agent, or Firm*—Taylor & Associates, P.C.

[57] ABSTRACT

A heat exchanger cools a process liquid in a paper-making machine using a source of cooling water. A first tank includes a plurality of first walls. A first inlet is connected to at least one of the first walls and the source and receives the cooling water from the source. A first outlet is connected to at least one of the first walls and the source. The cooling water is transported from the first outlet to the source. A second tank includes a plurality of second walls. The second tank has a second inlet connected with and receiving the process liquid from the paper-making machine, and a second outlet connected with and transporting the process liquid to the paper-making machine. An intermediate chamber is defined by and disposed between at least one of the first walls of the first tank and at least one of the second walls of the second tank. The intermediate chamber has a heat transfer liquid therein for transferring heat from the process liquid to the cooling water.

4 Claims, 1 Drawing Sheet

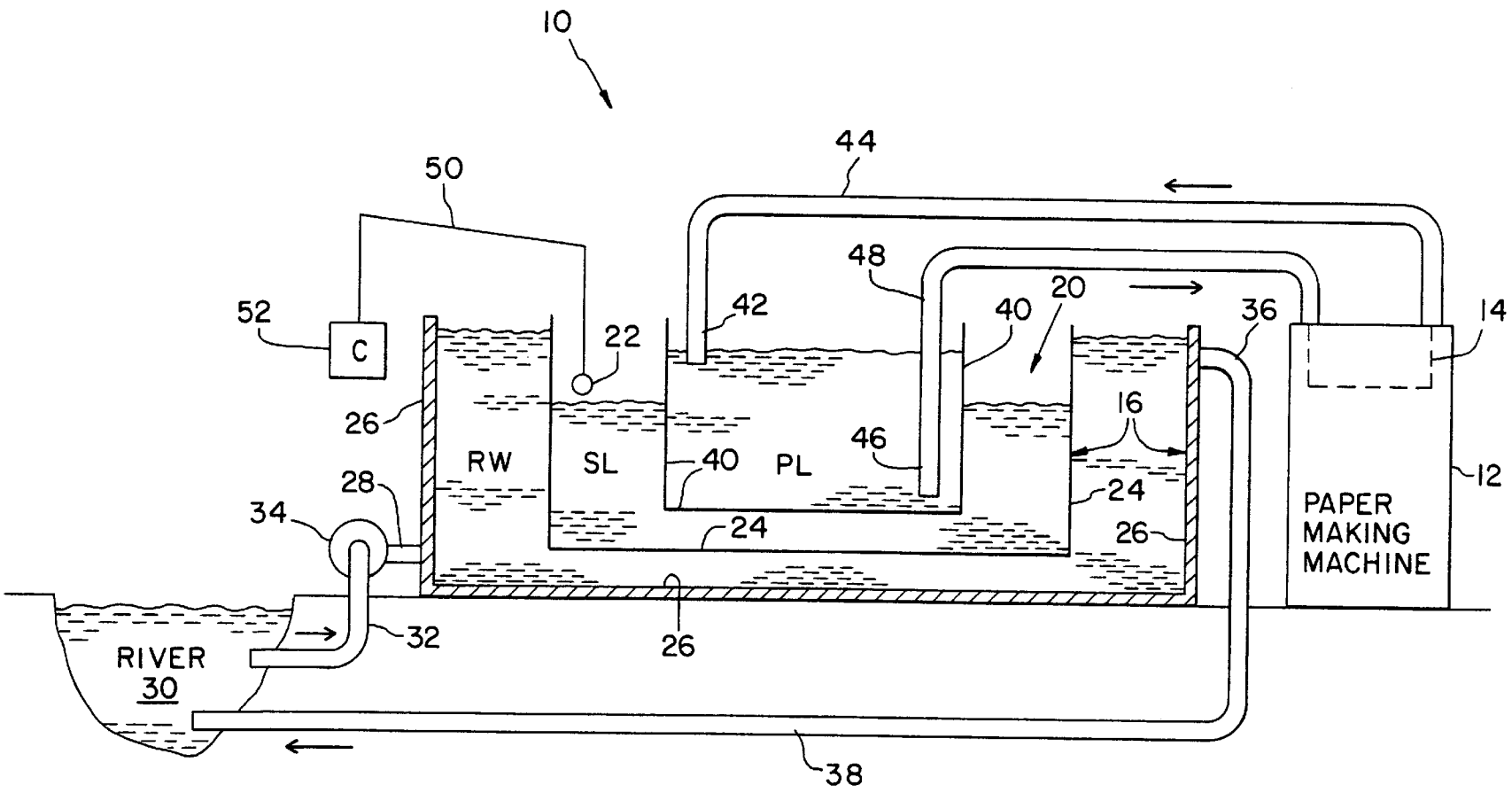
PAPER MAKING MACHINE
RIVER 30
PL
SL
RW
C
10
12
14
16
20
22
24
26
28
32
34
36
38
40
42
44
46
48
50
52

RIVER WATER HEAT EXCHANGER FOR COOLING PROCESS LIQUID IN A PAPER-MAKING MACHINE

BACKGROUND OF THE INVENTION

1. Field of the Invention

The present invention relates to a paper-making machine, and, more particularly, to a heat exchanger used to cool process liquid for use in a paper-making machine.

2. Description of the Related Art

A paper-making machine uses a plurality of different liquids during the paper-making process. Such liquids, i.e., process liquids, are used for example to make the fiber material web, and lubricate and/or cool certain mechanical components within the paper-making machine. The process liquid may be in the form of oil, condensate, ethylene glycol, etc. used to cool and/or lubricate various mechanical components within the paper-making machine. For example, the paper-making machine includes a plurality of rotatable rolls and cylinders which are carried at each longitudinal end thereof by associated bearing assemblies. Since the peripheral velocity of the rolls or cylinders may approach 6000 feet per minute and the rolls or cylinders may weigh several tons or more, it may be desirable to lubricate the bearing assemblies which carry the rolls or cylinders with a lubricating and cooling liquid.

Moreover, the process liquid may be considered as the fiber suspension which is being processed into a fiber material web within the paper-making machine. It is typically desirable to maintain the fiber suspension at an elevated temperature such that the water within the fiber suspension may be more easily transformed to a gas (i.e., steam) and thereby be removed from the fiber material web. However, it may be desirable for certain applications to decrease the operating temperature of the fiber suspension by cooling the fiber suspension.

It is known to cool a process liquid used in a paper-making machine by transporting the process liquid through a pipe which is submersed within a source of cooling water. For example, paper-making machines are commonly placed adjacent to a river which is used as a source of electrical and mechanical power, and may also be used to transport the wood logs consumed during the paper-making process. A long, metal pipe may be submersed within the river water. The process liquid is transported through the pipe and heat from the process liquid is transferred through the thermally conducting metal pipe into the lower temperature river water.

A problem with cooling the process liquid in a manner as described above is that a possibility of contamination of the river water by the process liquid exists. The metal wall of the pipe acts as an effective thermal conductor to transfer heat from the process liquid to the river water. However, the metal pipe may become damaged from mechanical impact and/or corrosion. The damaged pipe may allow the process liquid to flow into the river water, thereby contaminating the river water. Governmental fines and cleanup costs associated with such contamination may be expensive. Furthermore, loss of the process liquid in the paper-making machine may necessitate the replenishment of the process liquid, thereby also resulting in increased additional cost.

What is needed in the art is a heat exchanger for cooling a process liquid used in a paper-making machine using a source of cooling water, which adequately transfers the heat from the process liquid to the cooling water and also reduces the possibility of environmental contamination of the cooling water by the process liquid.

SUMMARY OF THE INVENTION

The present invention provides a heat exchanger for use with a paper-making machine which separates a flow of process liquid from a flow of cooling water using an intermediate chamber with a heat transfer liquid therein. The intermediate chamber and heat transfer liquid effectively conduct heat from the process liquid to the cooling water and define an environmental safety barrier between the process liquid and cooling water.

The invention comprises, in one form thereof, a heat exchanger for cooling a process liquid in a paper-making machine using a source of cooling water. A first tank includes a plurality of first walls. A first inlet is connected to at least one of the first walls and the source and receives the cooling water from the source. A first outlet is connected to at least one of the first walls and the source. The cooling water is transported from the first outlet to the source. A second tank includes a plurality of second walls. The second tank has a second inlet connected with and receiving the process liquid from the paper-making machine, and a second outlet connected with and transporting the process liquid to the paper-making machine. An intermediate chamber is defined by and disposed between at least one of the first walls of the first tank and at least one of the second walls of the second tank. The intermediate chamber has a heat transfer liquid therein for transferring heat from the process liquid to the cooling water.

An advantage of the present invention is that the process liquid is physically separated from the cooling water in a manner such that contamination of the cooling water by the process liquid is unlikely, thus rendering cooling of the process liquid more environmentally friendly.

Another advantage is that leakage of the process liquid or cooling water from an associated tank can be sensed.

Yet another advantage is that the flows of process liquid and/or cooling water may be stopped upon sensing of leakage of the process liquid or cooling water.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic illustration of one embodiment of a river water heat exchanger of the present invention connected to a paper-making machine.

The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown a schematic illustration of an embodiment of a river water heat exchanger 10 of the present invention connected to a paper-making machine 12.

Paper-making machine 12 may be of known construction and is therefore only shown schematically as a box in the drawing. Paper-making machine 12 is used for making a fiber material web from a fiber suspension, in known manner. The term "paper-making machine" as used herein, is broadly intended to cover a machine for making any type of fiber material web, such as paper, carton, cardboard or the like.

Paper-making machine 12 may use a plurality of process liquids such as fiber suspension, oil, condensate, ethylene glycol, etc. Depending upon the particular type of process liquid, paper-making machine 12 includes associated structure (shown schematically by dashed line 14) for carrying the particular process liquid through an associated portion of paper-making machine 12. For example, if the process liquid is a lubricating oil, the process liquid carrying structure 14 within paper-making machine 12 may be an enclosed bearing assembly through which the cooling and lubricating oil is transported. As a further example, if the process liquid is the fiber suspension from which the fiber web is formed, the process liquid carrying structure 14 may be in the form of a plurality of wires, felts, belts, rolls, etc., which carry the fiber suspension through paper-making machine 12. Such process liquid carrying structures are known and thus are not described in further detail herein.

Heat exchanger 10 generally includes a first tank 16, a second tank 18, an intermediate chamber 20 and a sensor 22.

First tank 16 has a plurality of first walls, including a plurality of inner walls 24 defining a generally U-shaped cross section and a plurality of outer walls 26 defining a generally U-shaped cross section. Inner walls 24 are disposed within outer walls 26 in spaced apart relationship relative thereto and are supported by appropriate structure (not shown). A first inlet 28 is connected to at least one of the outer walls 26. First inlet 28 is also connected to a source of cooling water, such as river 30, via a pipe 32 and pump 34. First inlet 28 is disposed near a bottom of first tank 16 in the embodiment shown but may be placed at other locations if desirable. Pump 34 pumps river water (RW) into the outer chamber defined by and between inner walls 24 and outer walls 26. The river water RW is disposed at a first level within the outer chamber defined by first tank 16. Of course, it may be necessary and/or desirable to provide appropriate filtering at the inlet of pipe 32 to inhibit sand, silt, etc. from being pumped into the outer chamber defined by first tank 16.

First tank 16 also includes a first outlet 36 which is connected with at least one of outer walls 26. First outlet 36 is also connected with the source of cooling water 30 via a pipe 38. First outlet 36 is disposed near the top of first tank 16 and establishes the flow level within first tank 16. That is, the river water RW is pumped into first tank 16 until the river water RW reaches a first level associated with the position of first outlet 36. The river water RW flows out through the first outlet 36 and is returned to river 30.

Second tank 18 is disposed within first tank 16 and includes a plurality of second walls 40. Second tank 18 includes a second inlet 42 which is connected with paper-making machine 12 via pipe 44. In the embodiment shown, second inlet 42 is suspended within second tank 18 via appropriate structure (not shown). However, second inlet 42 may also be directly attached to one of the second walls 40. Process liquid (PL) is transported from the process liquid carrying structure 14 within paper-making machine 12 through pipe 44 to second inlet 42. If the process liquid PL is in the form of a cooling liquid, second tank 18 may have a size, e.g., of about 5000 gallons. The process liquid PL is disposed within second tank 18 at a second level. In the embodiment shown, the second level of process liquid PL is different than the first level of the river water RW within first tank 16. However, the fluid levels of the process liquid PL and river water RW may also be the same, if desirable.

Second tank 18 also includes a second outlet 46 which is connected with the process liquid carrying structure 14 of paper-making machine 12 via pipe 48. Second outlet 46 terminates at a location near a bottom of second tank 18, such that the liquid level of the process liquid PL may vary somewhat within second tank 18 while still allowing effective transport of the process liquid PL from second outlet 46 to paper-making machine 12.

Intermediate chamber 20 is defined by and disposed between inner walls 24 of first tank 16 and second walls 40 of second tank 18. Intermediate chamber 20 includes a heat transfer liquid or environmental safety liquid (SL) therein. Heat transfer liquid SL is a thermally conductive liquid which transfers heat from the process liquid PL within second tank 18 to the river water RW within first tank 16. Second walls 40 and inner walls 24 are preferably constructed from a thermally conductive material, such as metal, to assist the heat transfer from process liquid PL to river water RW. Preferably, second walls 40 and inner walls 24 are constructed from a metal which is a good thermal conductor and resists corrosion, such as copper, titanium and/or cast iron, but may be constructed from other materials.

Intermediate chamber 20 and heat transfer liquid SL define an environmental safety barrier between process liquid PL and river water RW which inhibits contamination of river water RW. In the event that one of the second walls 40 or inner walls 24 develops a fracture or hole as a result of corrosion, the process liquid PL or river water RW leaks into intermediate chamber 20. The heat transfer liquid SL within intermediate chamber 20 is selected so as not to contaminate river water RW upon mixing therewith. In the embodiment shown, heat transfer liquid SL is water. However, heat transfer liquid SL may be in the form of another liquid which does not contaminate river water RW and has adequate heat conducting properties. Thus, if the river water RW leaks into intermediate chamber 20, the river water RW is not contaminated by the heat transfer liquid SL and is further not contaminated by the process liquid PL because of the remaining barrier defined by second walls 40. Contrarily, if one of the second walls 40 develops a hole as a result of corrosion and the process liquid PL leaks into intermediate chamber 20, the process liquid PL is prevented from mixing with the river water RW as a result of the remaining barrier defined by inner walls 24.

Sensor 22 is disposed within intermediate chamber 20 and senses a liquid level of heat transfer liquid SL. In the embodiment shown, sensor 22 is a float switch which is closed when the process liquid PL reaches a predetermined level. Sensor 20 is connected via a conductor 50 to a controller 52 and provides a signal to controller 52 when the liquid level of heat transfer liquid SL within intermediate chamber 20 reaches a height corresponding the placement location of sensor 22. Controller 52 is connected via appropriate interconnections (not shown) with each of paper-making machine 12 and pump 34 for controlling a flow of the river water RW or process liquid PL through first tank 16 or second tank 18, respectively.

During use, river water RW is transported through first tank 16 using pump 34; and process liquid PL is transported through second tank 18 using appropriate structure such as a pump (not shown). The heat transfer liquid SL within intermediate chamber 20 is maintained at a level which is below the level of both the process liquid PL and the river water RW. Thus, a pressure differential is provided between intermediate chamber 20 and each of the first tank 16 and second tank 18. During normal operation, heat is transferred from the process liquid PL to the river water RW through second walls 40, heat transfer liquid SL and inner walls 24. In the event that one of the inner walls 24 or second walls 40 develops a hole as a result of corrosion, impact, etc., and as a result of the above-described pressure differential, the process liquid PL or river water RW leaks through the hole in the corresponding wall 24, 40 into intermediate chamber 20, thereby resulting in a rise in the liquid level within intermediate chamber 20. The rise in liquid level of heat transfer liquid SL within intermediate chamber 20 in turn actuates sensor 22 which provides a signal to controller 52 via conductor 50. Controller 52 may be used to stop the flow of river water RW through first tank 16 and process liquid PL through second tank 18. Alternatively, since the size of a hole developed from corrosion would likely only be small and the liquid level within intermediate chamber 20 would rise relatively slow, controller 52 may simply sound an alarm allowing a user to investigate the cause of the alarm and manually stop the flow of river water RW and process liquid PL through heat exchanger 10, if necessary.

In the embodiment shown, river water RW and process liquid PL are simply transported through first tank 16 and second tank 18, respectively. However, it is also possible to install appropriate structure within first tank 16, second tank 18 and/or intermediate chamber 20 for inducing turbulence within river water RW, process liquid PL and/or heat transfer liquid SL. Agitation increases the convection heat transfer coefficient of the river water RW, process liquid PL and/or heat transfer liquid SL and thereby improves the thermal efficiency of heat exchanger 10.

Additionally, in the embodiment shown, each of first tank 16, second tank 18 and intermediate chamber 20 have an open top which is exposed to the ambient environment. However, it may be desirable for certain applications to enclose the top of first tank 16, second tank 18 and/or intermediate chamber 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of cooling a process liquid in a paper-making machine using a source of cooling water, said method comprising the steps of:

providing a first tank having a plurality of first walls, said first tank having a first inlet connected to at least one of said first walls and the source and a first outlet connected to at least one of said first walls and the source;

providing a second tank having a plurality of second walls, said second tank having a second inlet connected with the paper-making machine and a second outlet connected with the paper-making machine;

providing an intermediate chamber defined by and disposed between at least one of said first walls and at least one of said second walls, said intermediate chamber having a heat transfer liquid therein;

transporting the cooling water from the source to said first inlet and into said first tank;

transporting the process liquid from the paper-making machine to said second inlet and into said second tank;

maintaining a level of the heat transfer liquid below a level of the process liquid and below a level of the cooling water, and transferring heat through said heat transfer liquid in said intermediate chamber from the process liquid to the cooling water.

2. The method of claim 1, comprising the further step of sensing a liquid level of said heat transfer liquid in said intermediate chamber when said heat transfer liquid is at or above a predetermined level in said intermediate chamber, said sensing step indicating a leakage of at least one of the process liquid and the cooling water into said heat transfer liquid.

3. A method of cooling a process liquid in a paper-making machine using a source of cooling water, said method comprising the steps of:

providing a first tank having a plurality of first walls, said first tank having a first inlet connected to at least one of said first walls and the source and a first outlet connected to at least one of said first walls and the source;

providing a second tank having a plurality of second walls, said second tank having a second inlet connected with the paper-making machine and a second outlet connected with the paper-making machine;

providing an intermediate chamber defined by and disposed between at least one of said first walls and at least one of said second walls, said intermediate chamber having a heat transfer liquid therein;

transporting the cooling water from the source to said first inlet and into said first tank;

transporting the process liquid from the paper-making machine to said second inlet and into said second tank;

providing a pressure differential between the intermediate chamber and each of the first tank and the second tank, thereby causing at least one of the cooling water and the process liquid to flow into the intermediate chamber in the event of a leak in at least one of the first walls and the second walls; and transferring heat through said heat transfer liquid in said intermediate chamber from the process liquid to the cooling water.

4. The method of claim 3, wherein said step of providing a pressure differential includes a step of maintaining a level of the heat transfer liquid below a level of the process liquid and below a level of the cooling water.

* * * * *